US006620305B2

(12) United States Patent
Cornell et al.

(10) Patent No.: US 6,620,305 B2
(45) Date of Patent: Sep. 16, 2003

(54) METHOD AND APPARATUS FOR ELECTROCHEMICAL CELLS WITH IMPROVED ANTI-FOULING CHARACTERISTICS

(75) Inventors: Paul W. Cornell, Oceanside, CA (US); Stephen W. Cornell, Naperville, IL (US)

(73) Assignee: Cornell Development Corporation LLC, Naperville, IL (US)

( * ) Notice: Subject to any disclaimer, the term of this patent is extended or adjusted under 35 U.S.C. 154(b) by 90 days.

(21) Appl. No.: 09/829,841

(22) Filed: Apr. 10, 2001

(65) Prior Publication Data

US 2002/0144911 A1 Oct. 10, 2002

(51) Int. Cl.[7] ..... C25B 3/00; C25B 1/00
(52) U.S. Cl. ..... 205/413; 205/341; 205/342
(58) Field of Search ..... 205/334, 413, 205/341, 342

(56) References Cited

U.S. PATENT DOCUMENTS

| | | | | |
|---|---|---|---|---|
| 2,878,293 A | | 3/1959 | Kinzer | 260/607 |
| 3,207,660 A | | 9/1965 | Cannon | 167/30 |
| 3,264,355 A | | 8/1966 | Cannon | 260/606.5 |
| 3,422,152 A | | 1/1969 | Doub | 260/612 |
| 3,622,586 A | | 11/1971 | Jezic | 260/295 |
| 3,712,920 A | | 1/1973 | Jezic | 260/332.5 |
| 3,734,928 A | | 5/1973 | Jezic | 260/332.2 |
| 3,759,989 A | | 9/1973 | Jezic | 260/539 |
| 3,763,187 A | | 10/1973 | Moyle | 549/78 |
| 3,885,036 A | | 5/1975 | Moyle | 424/275 |
| 3,896,140 A | | 7/1975 | Plepys et al. | 260/307 |
| 3,899,405 A | * | 8/1975 | Iverson et al. | 204/149 |
| 3,944,498 A | | 3/1976 | Moyle | 252/106 |
| 3,981,897 A | | 9/1976 | Crivello | 556/54 |
| 4,007,227 A | | 2/1977 | Baker et al. | 260/566 |
| 4,136,102 A | | 1/1979 | Crivello | 556/20 |
| 4,207,310 A | | 6/1980 | Langford | 424/150 |
| 4,483,984 A | | 11/1984 | Flagg | 544/85 |
| 4,513,137 A | | 4/1985 | Koser et al. | 546/14 |
| 4,521,281 A | * | 6/1985 | Kadija | 204/25 |
| 4,544,450 A | * | 10/1985 | Oberrauch et al. | 204/59 R |
| 4,613,620 A | | 9/1986 | Cannon | 514/570 |
| 4,759,833 A | | 7/1988 | Lentz et al. | 205/338 |
| 5,106,407 A | | 4/1992 | Relenyi et al. | 71/88 |
| 5,277,767 A | | 1/1994 | Cushman et al. | 204/59 |
| 5,753,183 A | | 5/1998 | Ohr et al. | 422/37 |
| 6,083,408 A | | 7/2000 | Breitenback et al. | 210/753 |

OTHER PUBLICATIONS

Horn, "Pulse Plating", Dynatronix, Aug. 5, 1999, pp. 1–13.*

* cited by examiner

*Primary Examiner*—Edna Wong
(74) *Attorney, Agent, or Firm*—Wallenstein & Wagner Ltd.

(57) ABSTRACT

An electrolytic process for the preparation of a compound having a charged electrolytic cell fitted with at least one anode and at least one cathode in a single compartment with a reaction mixture. An electric potential is applied to the at least one anode and at least one cathode under conditions to promote formation of a compound on one of the cathodes or the anode to define a formation electrode. The formation electrode is then agitated.

26 Claims, 2 Drawing Sheets

METHOD AND APPARATUS FOR ELECTROCHEMICAL CELLS WITH IMPROVED ANTI-FOULING CHARACTERISTICS

TECHNICAL FIELD

The present invention concerns electrochemical preparation of diaryliodonium salts in a single or undivided electrolytic compartment or cell.

BACKGROUND OF THE INVENTION

The electrochemical formation of diaryliodonium salts is known for benzene with iodobenzene (see Wendt: H. Hoffelner, H. W. Lorch, H. Wendt, Journal of Electroanalytical Chemistry, 66 (1975), pp. 183–194) and toluene with iodobenzene (see Miller: Larry L. Miller, A. K. Hoffman, JACS, 89 (1967), pp. 593–597) using platinum electrodes, divided cells, acetonitrile solvent and perchlorate electrolyte. In both cases, these do not represent commercially feasible sets of conditions. Divided cells are more expensive to operate due to additional voltage drop in the cell. Platinum is too expensive for anode material on a commercial scale. Furthermore, the electrodes of these systems are prone to coating by reaction by-products, thereby inhibiting their effectiveness.

Other prior art of interest includes U.S. Pat. No. 4,759,833 which discloses the simultaneous preparation of a diaryliodonium salt and an alkoxide salt using a divided cell. The only anode taught in this patent is platinum.

Diaryliodonium salts have a variety of uses, such as photoinitiators (U.S. Pat. Nos. 4,136,102 and 3,981,897), fungicides (U.S. Pat. Nos. 3,944,498 and 3,763,187) and bactericides (U.S. Pat. Nos. 3,885,036 and 3,712,920). Thus, it would be desirable to have a more economically and industrially feasible process for preparing such compounds, as well as for preserving the effectiveness of the electrodes. A new electrochemical method for synthesizing diaryl iodonium compounds has been developed and patented by Cushman, et. al. (U.S. Pat. No. 5,277,767), which is less costly and able to compete effectively with the traditional methods.

SUMMARY OF THE INVENTION

The present invention is directed to an electrolytic process for the preparation of a compound including the steps of: (1) charging an electrolytic cell fitted with at least one anode and at least one cathode in a single compartment with a reaction mixture, (2) applying electric potential to the anode and the cathode under conditions to promote formation of a compound on one of the cathodes or one of the anodes to define a formation electrode, and (3) agitating the formation electrode to facilitate the removal of the compound.

BRIEF DESCRIPTION OF THE DRAWINGS

The above and other objects, features, and advantages of the present invention will become apparent from a consideration of the subsequent detailed description presented in connection with the accompanying drawing, in which.

DETAILED DESCRIPTION

While this invention is susceptible of embodiments in many different forms, and will herein be described in detail, preferred embodiments of the invention are disclosed with the understanding that the present disclosure is to be considered as exemplifications of the principles of the invention and are not intended to limit the broad aspects of the invention to the embodiments illustrated.

This invention provides for the synthesizing of electrolytic compounds in an electrochemical cell. In a preferred form, the invention provides for the synthesis of diaryl iodonium compounds. The iodonium compounds of the present invention are, in a preferred form of the invention, prepared using the process set forth in U.S. Pat. No. 5,277,767 which has been incorporated herein and made a part hereof in its entirety.

Figure 1:
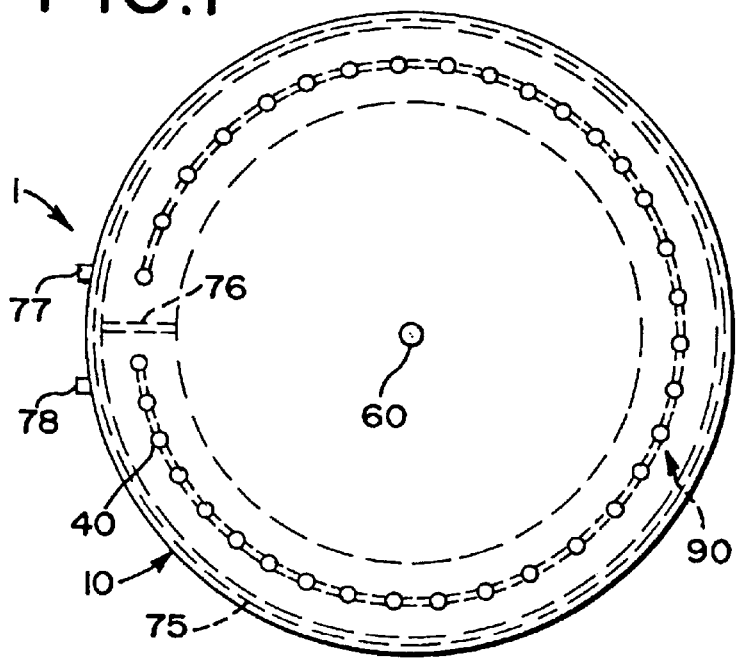
FIG. 1 is a top view cross section of the electrochemical cell of the present invention.
Figure 2:
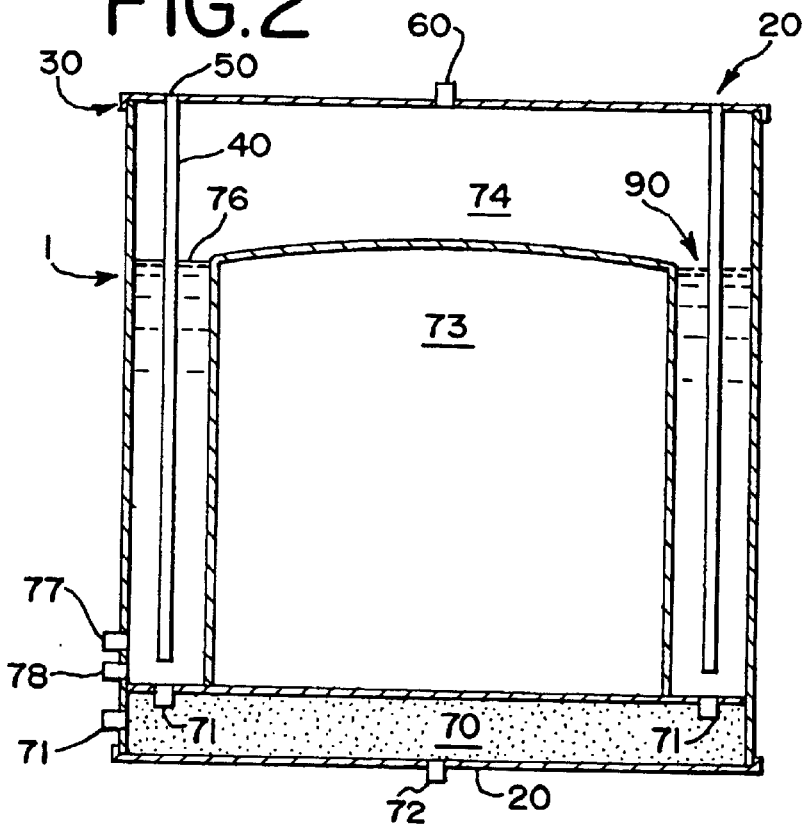
FIG. 2 is a side view cross section of the electrochemical cell of the present invention.

In a preferred form of the invention, an electrode cell 1 is shown in FIGS. 1 and 2 and is used to produce diaryliodonium salts from starting materials contacting the cell 1. Suitable starting materials include heterocyclic or preferably a carbocyclic aromatic compound containing 6 to 11 carbon atoms. It is also possible that the iodoaryl compound can be substituted with groups such as halides, alkyl groups having 1 to 12 carbon atoms, vinyl groups, carboxylic acids or esters, ethers and the like. Preferred iodoaryl compounds include iodotoluene, iodobenzene, iodonaphthalene, iodobenzene substituted with 1 to 5 substituents independently selected from —R,—OR, and wherein R is an alkyl group of 1 to 12 carbon atoms, and the like.

The aryl compound employed as a starting material in the process of the present invention is heterocyclic or preferably a carbocyclic aromatic compound containing 6 to 11 carbon atoms. The aryl compound of the invention is distinguished from the iodoaryl compound of the invention in that the latter is substituted with iodine and the former compound is not. Preferred aryl compounds include benzene, toluene, naphthalene, or other polycyclic aromatic compounds. It is also possible that the aryl compound can be substituted with groups such as halides (i.e., F, Br, or Cl), alkyl groups having 1 to 12 carbon atoms, vinyl groups, carboxylic acids or esters, ethers, and the like.

Generally, the optional substituents on the aryl and iodoaryl compounds can be any group or groups that do not have substantial adverse effects on preparation of the desired compound.

The process of the invention is conducted using a solvent for the iodoaryl compound, aryl compound and an electrolyte. The solvent can be selected from the group consisting of polar solvents, and preferably acyclic polar solvents. Examples of solvents suitable for use with the present invention are alcohols such as methanol, halogenated hydrocarbons such as dichloro methane and chloroform, acetonitrile, organic acids, and the like. The most preferred solvent is acetic acid.

The electrolyte for use in the process of the present invention is one which will conduct an electric current and not have substantial adverse effects on preparation of the desired diaryliodonium compound. Additionally, the electrolyte can function partially or totally as the reaction solvent. Examples of suitable electrolytes include strong acids such as p-toluene-sulfonic acid and, preferably, sulfuric acid. Other useful electrolytes include organic salts.

Suitable organic salts include alkali and tetraalkylammonium salts of weak organic acids. However, stronger organic acids may also be utilized. Examples of suitable salts are the sodium, potassium, lithium and ($C_1$–$C_{12}$)tetraalkyl ammonium salts of acetic acid, trihaloacetic acid, p-toluenesulfonic acid, HI, HBr, $HBF_4$ and benzenesulfonic acid, among others.

Preferred electrolytes are compounds of fluorine, sulfuric acid or a combination thereof. Examples of compounds of fluorine include NH:HF and HF. It is preferred that HF is used in combination with a minor amount of $H_2SO_4$.

It is important to use an electrolyte that is stable (i.e., unreactive) under the conditions of the electrolytic process. For example, use of electrolytes that have a Cl atom, such as NaCl or $ClSO_3H$, will typically result in unwanted production of $Cl_2$ (easier to oxidize) and little or none of the desired product.

The electrolyte and/or solvent must be capable of contributing an ion as the counter ion of the compound in order to have a salt of the compound. Typical salts include, for example, sulfates, halides such as fluorides, acetates, phosphates, and the like. It may be desirable, after performing an ion exchange for the anion for purposes of, for example, improved solubility or end use efficacy (e.g., enhanced biocide activity). An example of such an ion exchange is exchanging a sulfate ion with an iodide or chloride ion.

The process of the invention is carried out in an undivided or single compartment electrolytic cell equipped with at least one cathode and at least one anode. The preferred reaction section is an electrode bearing cell in flow communication with a vessel containing an agitant. As illustrated in FIGS. 1 and 2, the electrode cell 1 consists of a glass tube 10 capped with ultra high molecular weight high density polyethylene (UHMW-HDPE) flanges 20, secured with external clamps 30. This facilitates removal for maintenance or alterations to the process. The entire cell 1 may also be constructed of UHMW-HDPE, polypropylene, or other plastics. The top flange 20 may be a UHMW-HDPE disc. Threaded into this disc are electrode rods 40 having electrical connector fasteners at the outside ends 50. The electrode rods 40 may be anodes or cathodes. The outside ends 50 protrude through the disc.

The cathode may be encased in a plastic mesh to prevent bridging of conductive agitants that may create a short in the cell. Electrode spacing may vary, but can be in the form of a single line of alternating anodes and cathodes, or in a double line alternating in each arrangement, or the same in each arrangement. The electrode spacing may be uniform, or may decrease as the mix becomes more electrically resistant and less conductive toward the cell outlet. The electrode pairs may be arranged within the cell in numerous configurations. Such configurations include geometric pattern arrangements, evenly-spaced arrangements, and non-evenly-spaced arrangements.

The top flange 20 also contains a gas outlet 60 to allow for the discharge of cell-generated gases, in addition to non-reacting gas used for agitation.

The bottom flange 20 is a double disc of UHMW-HDPE to provide a non-reacting gas distribution chamber 70, gas inlet 71, and liquid drain 72. Bottom flange 20 supports a self-draining center drum 73 with a sloping head 74. Center drum 73 is sized so that the volume above is adequate to disengage any entrained liquid from the gasses leaving the cell 1 through top outlet 60. Center drum 73 provides the flow path for the reactants and the product with the electrodes 40 located between it and outer shell 75.

Figure 3:
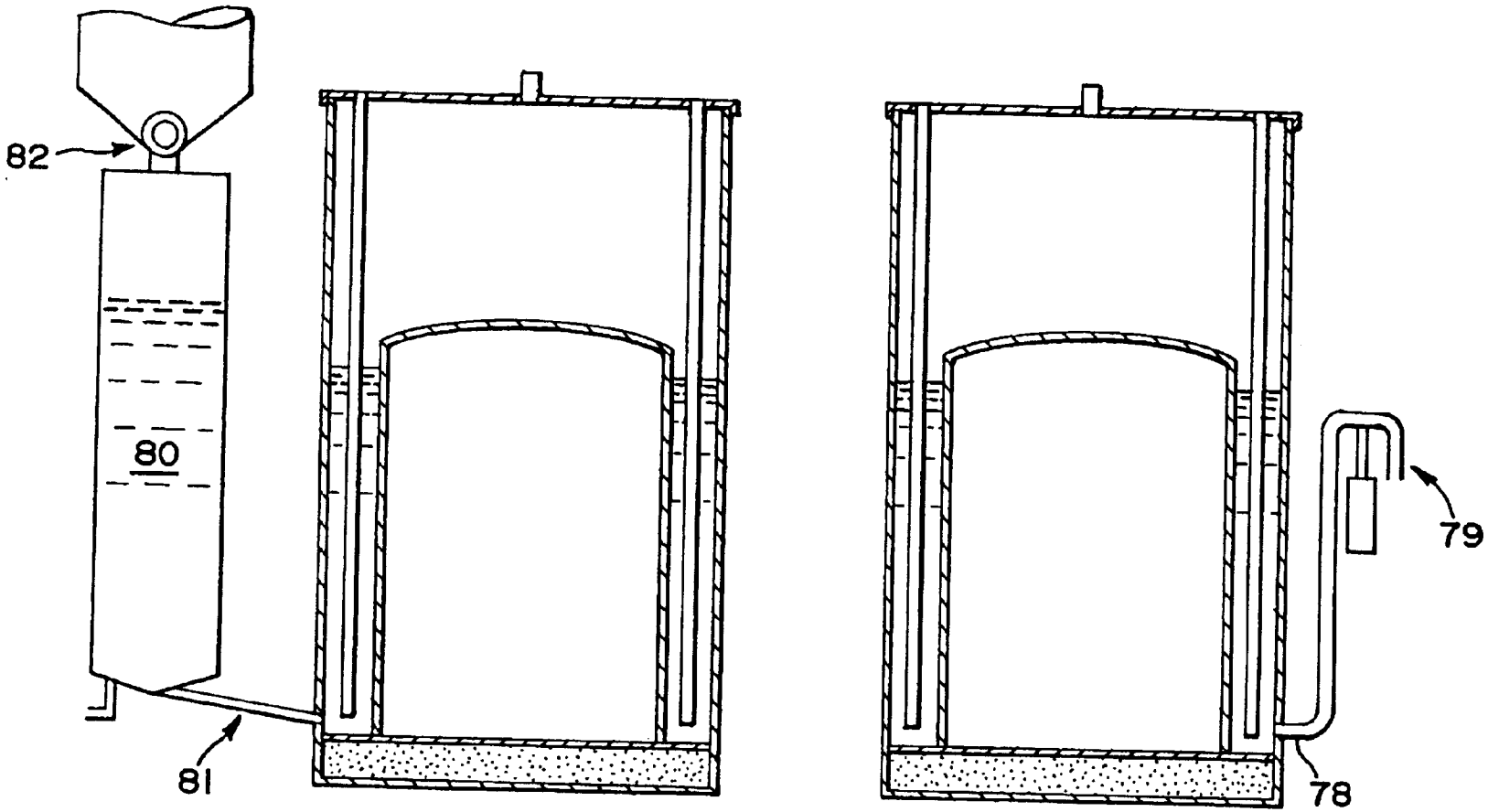
FIG. 3 is a side view cross section of the electrochemical cell in flow communication with the vessel containing the reaction mixture.

Attached to the center drum 73, and the fitting tight against the outer shell 75, is a wall segment 76 that acts as a dam or weir, about the height of the center drum 73. On one side of the wall or dam 76, and near its base, is cell inlet 77. Cell outlet 78 is on the other side of the dam 76 and situated near its bottom. As shown in FIG. 3, flow through the cell 1 is controlled by anti-siphon conduit 79 of variable height on outlet 78 and feed chamber 80 at inlet 77 to maintain fluid level at the entrance. The difference between the levels on both sides of the dam 76 controls the flow rate of material through the cell.

Inlet feed 81 can include a mixture of the reactants, the electrolyte and agitants (inert or conductive to also act as an electrode supplement). Feed rate of these moieties into the cell may be controlled by variable speed pump 82, such as one with a rotating drum shaft equipped with chambers to meter a controlled amount of feed during each rotation cycle. Feed inlet 81 may also regulate the feed communicated to the cell 1. Electrolyte level may be regulated by the position of the feed inlet 81 as well. The feeding drum so described may be equipped with a mixing device, as well as employ a bottom feed pump to develop and maintain the proper balance of constituents in the feed stream.

The nature of the anode for use in the process of the invention is important to achieve increased current efficiency. The anode preferably consists of carbon. The form of the carbon anode is not critical. Thus, the anode can be carbon felt, vitreous or glassy carbon, graphitic carbon, or carbon cloth, consistent with the configuration and spacing described in the figures.

The nature of the cathode for use in the process of the invention has been found not to be particularly critical. Thus, the cathode can be comprised of carbon, zinc, platinum, nickel, cadmium, tin, copper, stainless steel, vanadium, and the like. The preferred cathode, however, is carbon.

The reaction mixture for the process of the present invention preferably contains a minor amount of a drying agent, for example about 1% to about 25%, based on the total weight of the reaction mixture, in order to remove any water present or generated during the process.

Examples of drying agents include molecular sieves and organic acid anhydrides. It is preferred that the drying agent is the anhydride corresponding to the organic acid if an organic acid is used as the reaction solvent. Thus, if acetic acid is used as the solvent, the preferred drying agent is acetic anhydride.

To carry out the process of the invention, the single compartment 90 is charged with the reactants, solvent and electrolyte. An electric potential, preferably about 1.75 volts to 4.5 volts, and more preferably 2.5 volts to 3.5 volts, depending on electrode spacing, is then applied to the anode and cathode. Electric potential as referred to herein as SCE. The electric potential is typically applied to the anode and the cathode for a period of time of about 2 to 10 hours, and preferably about 5 to 7 hours. The reaction can be conducted under various conditions. For example, temperatures of about 25° to about 85° C., and preferably about 27° to about 65° C., and pressures of about 1 atm to 10 atm, and preferably about 1 atm to 2 atm are typical. The solution's electrical conductivity increases as temperature is raised from room temperature up to the boiling point of at least one of the reactants. In one embodiment of the invention, the electric potential is applied to the anode and the cathode as a constant electric potential.

The amount of electrolyte can vary, as it can be used as all or part of the solvent. For example, about 0.05% to about 99% electrolyte based on the total weight of the reaction mixture can be employed. A preferred amount of electrolyte is about 0.05% to about 5% where the electrolyte is not intended to function as solvent, Typical current efficiency of the process of the present invention is greater than about 50%, preferably greater than about 75%, and more preferably greater than about 95%.

The process of the present invention avoids excessive fouling of the electrode by reaction by-products. Preferably the process is for the manufacture of aryl iodonium compounds with the carbon electrodes, more preferably to other electrochemically produced compounds that have electrode fouling, as well as to other electrode materials that exhibit a need for cleaning.

The process of the present invention utilizes a solid bead. The bead may be made of silica, ceramic, or refractory materials, such that the bead is electrically non-conductive. The bead may also be made of carbon, similar to the sintering process for making electrodes, such that the bead is electrically conductive. The electrically conductive bead making process utilizes the coking of petroleum moieties, the calcining of such coke to remove volatiles, the grinding thereof, mixing with pitch, formation of beads, and the baking of the beads into a solid form. The details of this process are known to those skilled in the art.

The improved reaction cell for the iodonium process, using an undivided cell as taught by Cushman, et al. in U.S. Pat. No. 5,277,767, and disclosed herewith, can be used in the removal or dislodging of species that adhere to the electrode during the synthesis of compounds. A first process is simple agitation using a non-reactive gas, such as nitrogen, to scrub the electrode free of these "insulators". A second process is to utilize ceramic or glass non-conducting "beads" which are agitated by mechanical stirring or by the introduction of sufficient inert gas to provide the needed fluidizing motion. A third process provides an additional electrode working surface in the form of current conducting carbon beads, traveling through the process to accept the major portion of the electrode contamination. In various embodiments, the carbon beads can lengthen the time before the primary carbon electrodes must be mechanically and/or chemically cleaned. The carbon beads may be used as carriers for the iodonium product. The carbon beads may further be used as sacrificial anodes, or getters, as the site of reaction by-product deposition. The carbon beads are electrically conductive and are fed through the process at a rate necessary to maintain the electrical conductivity of the system.

In one embodiment of the present invention, it may be useful to utilize a mixture of electrically conductive and electrically non-conductive beads to control the rate of deposition on the carriers, and further to control the rate of mechanical cleaning of the primary electrodes.

In another embodiment of the present invention, it may be useful to periodically pulse the electric current through the electrode to assist the mechanical cleaning of the primary electrodes.

In yet another embodiment of the present invention, it may be useful to periodically reverse the direction of electric current flow to assist the mechanical cleaning of the primary electrodes.

In another embodiment of the present invention, it may be useful to employ some or all of the aforementioned embodiments during the product purification stage, the bead purification stage, or the second stage separator to recover the compound in the most economical manner.

In yet another embodiment of the present invention, it may be useful to provide heating or cooling in the form of a heat exchanger to regulate the optimum operating temperature within the cell.

In still another embodiment of the present invention, it may be useful to provide for regulation of the pressure within the cell for situations where the reaction rate is influenced by pressure.

In yet another embodiment of the present invention, it may be useful to provide multiple feed port locations to introduce reactants at different stages of the reaction. One means of introducing reactants is by recycle stream location. In this embodiment the concentration of intermediate products can influence the reaction rates and the competing reactions for a specific SCE. Another means is to use the heating or cooling from the heat exchanger to regulate the optimum operating concentrations within the cell.

A preferred process of the invention can be described as an electrolytic process for the preparation of a compound including the steps of: (1) charging an electrolytic cell fitted with at least one anode and at least one cathode in a single compartment with a reaction mixture, (2) applying electric potential to the anode and the cathode under conditions to promote formation of a compound on one of the cathodes or the anode to define a formation electrode, (3) agitating the formation electrode to facilitate the removal of the compound, and (4) a recycle loop to pass partially reacted reactants to the electrodes again.

The products produced by the present invention have at least one of the following uses: photoinitiators, chemical intermediates, pharmaceutical intermediates, fungicides, bactericides, or viricides.

The invention is further illustrated by the following non limiting example. All percentages are by weight unless otherwise indicated.

EXPERIMENTAL

All work was conducted with a cell similar to that described in the figures using carbon anodes and cathodes.

To the 4% sulfuric acid electrolyte, 70% acetic acid solvent, 6% acetic anhydride drying agent, and 20% silica bead agitant slurry was added 20% reagent to make the diaryliodonium salt. The slurry was metered by adjusting the height of the inlet anti-siphon so that the cell was filled with material to one half of the volume of the cell, as defined by the wall dam. A nitrogen sparger tube along the inner wall was maintained at between 30–60 psi to produce a constant stream of bubbles to agitate the beads. The nitrogen gas flow rate was adjusted until it provided a good agitation of the slurry. At this point, the 3.5 volt electric potential was applied between the carbon electrodes with a current of 100 amps, and the outlet anti-siphon was located 2 inches below the inlet anti-siphon to create the flow through the cell. The volumetric flow rate was controlled by valving to produce a turnover rate in the cell four times every one hour. A 20% recycle stream was introduced to the cell just downstream of the inlet and controlled volumetrically at this level. After six hours the reaction was terminated. Examination of the electrodes showed less product build up on the anode than was observed for the control experiment without the beads. Acetic acid solvent was added to the control to substitute for the volume occupied by the beads.

Similar experiments were conducted using different concentrations in the recycle stream until the optimum proportion was discovered for this particular set of reactants. Other reactants have different ratios of feed and recycle.

The invention has been described in detail with particular reference to preferred embodiments thereof, but it will be understood that variations and modifications can be effected within the spirit and scope of the invention.

We claim:

1. An electrolytic process for the preparation of an organic compound comprising:

charging an electrolytic cell fitted with electrodes comprising at least one anode and at least one cathode in a single compartment with a reaction mixture of at least one reactant compound, an electrolyte, and a solvent;

applying an electric potential to at least one of the electrodes under conditions to promote formation of an organic compound on at least one of the electrodes to define a formation electrode; and providing agitation at the formation electrode to prevent the formation of or to remove a fouling byproduct from the formation electrode by supplying inert gas under pressure through the reaction mixture.

2. The process of claim 1 wherein the at least one anode is a carbon anode.

3. The process of claim 2 wherein the at least one cathode is selected from the group consisting of carbon, cadmium, copper, nickel, platinum, tin, stainless steel, vanadium, and zinc.

4. The process of claim 3 wherein the at least one anode and at least one cathode are textured.

5. The process of claim 1 wherein the inert gas is nitrogen.

6. The process of claim 1 wherein the step of providing agitation comprises the step of supplying beads to the mixture.

7. The process of claim 6 wherein the beads may be either conductive or non-conductive.

8. The process of claim 7 wherein the beads are conductive and electrically charged and cling to the formation electrode.

9. The process of claim 7 wherein the beads are ceramic, glass, or silica and non-conductive.

10. The process of claim 7 wherein the conductive beads are carbon.

11. The process of claim 7 wherein the non-conductive beads are ceramic, glass, or silica.

12. The process of claim 1 wherein the step of applying an electric potential comprises the step of pulsing current.

13. The process of claim 1 wherein the step of applying an electric potential is periodically reversed.

14. The process of claim 1 wherein the step of applying an electric potential comprises the step of regulating the electric potential.

15. The process of claim 1 wherein the step of applying an electric potential further comprises the step of independently adjusting at least one electrode pair.

16. An electrolytic process for the preparation of an organic compound comprising:

charging an electrolytic cell fitted with electrodes comprising at least one anode and at least one cathode in a single compartment with a reaction mixture comprising at least one reactant compound, a stable electrolyte, and a solvent;

applying an electric potential to at least one of the electrodes under conditions to promote formation of an organic compound on at least one of the electrodes to define a formation electrode;

providing at least one bead in the reaction mixture; and supplying at least one feed inlet and additionally a recycle stream inlet within the cell to provide agitation within the cell by moving the at least one bead to separate a byproduct from the formation electrode.

17. The process of claim 16 wherein the at least one anode is a carbon anode.

18. The process of claim 17 wherein the at least one cathode is selected from the group consisting of carbon, cadmium, copper, nickel, platinum, tin, stainless steel, vanadium, and zinc.

19. The process of claim 16 wherein the at least one anode and at least one cathode are textured to prevent bridging.

20. The process of claim 16 wherein the bead is a current conducting bead.

21. The process of claim 20 wherein the formed compound electrically clings to the current conducting bead.

22. The process of claim 20 wherein the current conducting bead is carbon.

23. The process of claim 16 wherein the at least one bead is a plurality of beads including a mixture of non-current conducting beads and conducting beads.

24. The process of claim 23 wherein the plurality of beads contact the formation electrode to separate the byproduct from the formation electrode.

25. The process of claim 24 wherein the non-current conducting beads are ceramic, glass, or silica.

26. The process of claim 25 wherein the reaction mixture is added to the cell at two or more locations within the cell.

* * * * *